US007999688B2

(12) United States Patent
Healey et al.

(10) Patent No.: US 7,999,688 B2
(45) Date of Patent: Aug. 16, 2011

(54) EMBEDDED ASSESSMENT OF REFUSE FOR ACTIVITY MONITORING

(75) Inventors: Jennifer Healey, Waltham, MA (US); Beth Logan, Cambridge, MA (US)

(73) Assignee: Intel-Ge Care Innovations LLC, Roseville, CA (US)

( * ) Notice: Subject to any disclaimer, the term of this patent is extended or adjusted under 35 U.S.C. 154(b) by 907 days.

(21) Appl. No.: 11/961,509

(22) Filed: Dec. 20, 2007

(65) Prior Publication Data

US 2009/0161907 A1 Jun. 25, 2009

(51) Int. Cl.
*G08B 21/00* (2006.01)

(52) U.S. Cl. ..... 340/613; 340/573.1; 340/612

(58) Field of Classification Search ..... 340/613, 340/573.1, 666, 540, 506, 511, 612, 686.1, 340/3.1, 4.1; 382/100
See application file for complete search history.

(56) References Cited

U.S. PATENT DOCUMENTS

2010/0071572 A1* 3/2010 Carroll et al. ..... 100/229 A

OTHER PUBLICATIONS

"Clever toilet checks on your health", CNN.com, Jun. 28, 2005, Internet search at http://cnn.worldnews.printthis.clickability.com/pt/cpt?action=cpt&title=CNN.com+–+Cleve...May 2, 2008; Internet article at: http://www.cnn.com/2005/TECH/06/28/spark.toilet /index.html, (2 pages).

Healey, Jennifer, et al., "StartleCam: A Cybernetic Wearable Camera", In Proc. ISWC 1998, Wearable Computers, 1998; Digest of Papers, Second International Symposium on http://ieeexplore.ieee.org/xpl/RecentCon.jsp?punumber=5898, Publication Date: Oct. 19-20, 1998, Meeting Date: Oct. 19, 1998-Oct. 20, 1998, (pp. 42-49).

* cited by examiner

*Primary Examiner* — Toan N Pham

(74) *Attorney, Agent, or Firm* — Pillsbury Winthrop Shaw Pittman LLP

(57) ABSTRACT

Embodiments of the present invention provide devices and methods for monitoring the waste output of one or more individuals. Embodiments provide a waste receptacle equipped with one or more cameras capable of imaging the contents of the waste receptacle and optionally a scale that is capable of measuring the weight of the waste receptacle or the weight of the contents of the waste receptacle. The waste receptacle optionally communicates wirelessly with a base station that is able to store images of the contents of the waste receptacle and communicate automatically with remote caregivers. Algorithms are provided that are capable of providing a signal to a caregiver to alert the caregiver if the waste receptacle is not in use.

12 Claims, 3 Drawing Sheets

EMBEDDED ASSESSMENT OF REFUSE FOR ACTIVITY MONITORING

BACKGROUND OF THE INVENTION

1. Field of the Invention

The embodiments of the present invention relate generally to devices and methods that can be used to monitor activity of one or more individuals in a non-intrusive manner, and more specifically, to devices that are capable of monitoring the waste matter output of one or more individuals.

2. Background Information

Human populations throughout the world are aging. As people age, health issues that require monitoring and regular attention can make it difficult for an individual to remain in their home. Individuals whose health conditions are severe enough to require regular monitoring and care frequently must go to an institutionalized place that can provide the care. Most individuals would prefer to remain in their own homes for as long as possible instead of going to an institutionalized place of care. Additionally, the societal cost of care for individuals with chronic health issues is lower for individuals that are able to remain at home.

Technologies that can monitor an individual in their home provide the welcome possibility that an individual may be able to stay at home for longer. Additionally, health conditions such as diabetes and congestive heart failure can benefit from monitoring by a caregiver. Typically, an individual and/or their daily activities will be monitored in the home and the information transmitted to caregivers who are remote from the individual. The caregivers can monitor the information received to determine information about the health of the individual and determine whether or not the individual requires care.

DETAILED DESCRIPTION OF THE INVENTION

Embodiments of the present invention provide non-invasive automatic methods and devices for monitoring human activities. Non-invasive devices and methods are preferred as personal privacy is highly valued by individuals. More specifically, embodiments of the present invention provide methods and devices for monitoring one or more individual's waste output over time. The devices are simple to install and capable of integrating with existing monitoring systems. These devices and methods are useful, for example, in monitoring the health and activity of an individual who may have a chronic health condition requiring occasional or frequent medical attention. By monitoring a person's waste output, things such as amount, type, frequency, and time of activity can be determined. For example, for an elder living alone, periodically changing levels of trash indicate mobility and in the case of kitchen trash, may also indicate regular eating activities.

Figure 1:
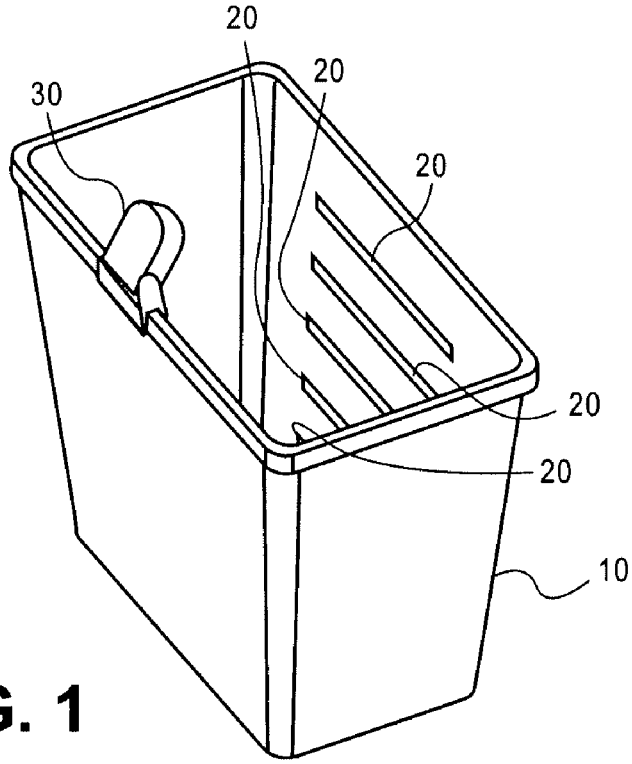
FIG. 1 provides an example of a monitoring system comprising a waste receptacle and a camera that is connected to a docking station (not shown).

Embodiments of the invention comprise a waste receptacle, such as a container used to accommodate trash, and a camera capable of monitoring the contents of the waste receptacle. The camera may be attached to a side of the waste receptacle or it may be integrated into the body of the receptacle. Referring to FIG. 1, the interior of the waste receptacle 10 may optionally be provided with markings 20 that are visible to the camera 30 and demark various levels of fullness within the trash receptacle. The camera 30 is capable of communicating either through a hard-wired connection to a docking or base station (not shown) or wirelessly through a docking or base station. The camera 30 may optionally receive power through a wired connection to a docking station. The camera 30 captures images of the interior of the waste receptacle 10. The images taken by the camera may optionally be time-stamped by the camera. The images taken by the camera may be analyzed by standard image processing algorithms in order to determine the level of the trash in the waste receptacle. Additionally, images of the waste receptacle contents may be saved or transmitted to a remote user to be viewed by a caregiver.

Figure 2:
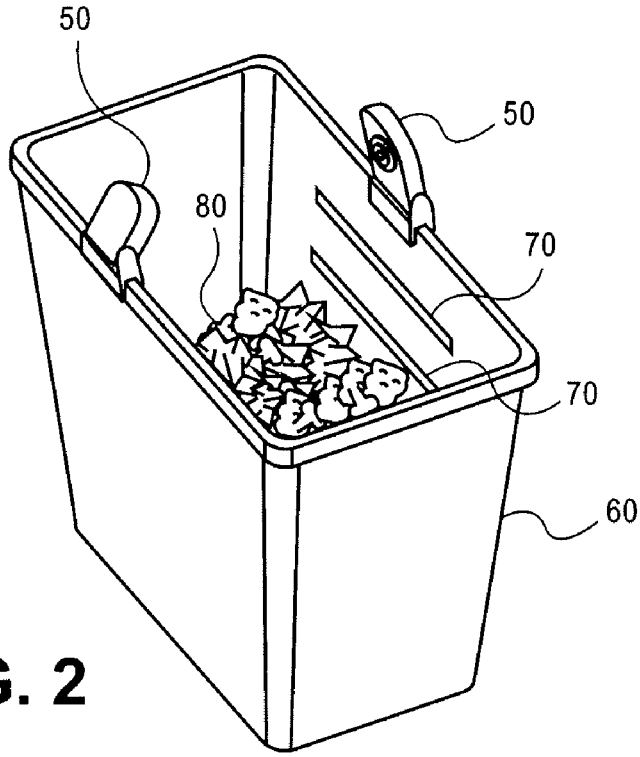
FIG. 2 provides an additional example of a monitoring system comprising a waste receptacle and cameras that are connected to a docking station (not shown).

In alternate embodiments, the waste receptacle may comprise more than one camera that is capable of photographing the interior and contents of the waste receptacle. The two or more cameras are placed in a manner that allow them to take pictures from different perspectives, so that if one camera becomes blocked by a particularly large item of waste, another camera may still be able to photograph the contents of the interior of the waste receptacle. In an exemplary embodiment shown in FIG. 2, two cameras 50 are placed on opposite sides of a waste receptacle 60 and are able to capture images of the interior of the waste receptacle. The interior of the waste receptacle are marked with lines 70 useful for determining the level of waste 80 within the receptacle.

Optionally, the waste receptacle may also be equipped with a scale that is capable of measuring the weight of the contents of the waste receptacle. If the waste receptacle contains trash that blocks the camera's ability to record the contents of the waste receptacle, the scale can provide an additional mechanism to determine whether or not trash is being placed in the waste receptacle. The scale may be built into the waste receptacle or located below the waste receptacle. The scale communicates with a base station either wired or wirelessly.

Additional embodiments provide a waste receptacle and a scale that is capable of measuring the weight of the contents of the waste receptacle or the weight of the waste receptacle. The scale may be built into the waste receptacle or located below the waste receptacle. The scale communicates with a docking and or base station either through wired or wireless connectivity. The activity of an individual is monitored by monitoring changes in the weight of the waste in the receptacle. If no changes are detected for a set time period, an alarm is sent to a caregiver.

Further optionally, the waste receptacle may contain an indicator alarm, such as a light or noise, to alert a user to the state of the monitoring system. For example, if the cameras are not able to image the contents of the waste receptacle, the indicator light may be lit or an alarm may sound. The alarm optionally is context aware and notifies the user when a user opens the lid of the waste receptacle or places an item in the waste receptacle. The use of the waste receptacle by an individual is determined by a lid (or cover) opening, a sensor (such as a photodetector) that detects an object passing by the edge of the can, or a change of weight detected by the scale.

The one or more cameras take images at constant time intervals and or when waste is placed in the waste receptacle. In the case of a trash receptacle having a lid (or cover), images are optionally taken when the lid opens. The imaging function is triggered when the lid opens, for example, by a light sensor, by a foot pedal, or by a motion sensor. Additional triggers, such as a photo detector that is capable of triggering when additional trash passes the rim of the waste receptacle are possible. Optionally, the waste receptacle is equipped with a flash or other light emitting mechanism to facilitate imaging when ambient light is low.

Waste receptacles according to embodiments of the present invention may be placed in any location. For example the waste receptacle may be placed in the kitchen, the bathroom, a living room, a bedroom, or a dining room. The trash receptacle may also be equipped with a lid and or a foot pedal that when it is depressed the lid opens. If a user desires to use a liner in the waste receptacle, such as a trash bag, the liner can be transparent so that lines or colors may be viewed through it or the liner can contain lines (or background color) that the cameras are capable of imaging.

In embodiments of the invention, a camera is a device that is capable of capturing an image and storing it in a computer-accessible medium or format. Typically, a camera consists of a lens positioned in front of an opening in an enclosed space capable of focusing light comprising the image to be recorded onto a recording surface and a shutter to prevent or allow light to enter through the aperture. The camera also comprises some form of memory for storing the image captured and a control mechanism that allows instructions provided to the camera to take a photograph to be acted on by the camera and an output mechanism allowing captured images to be output to another device, such as a docking station, memory card, or base station. Both the input mechanism for providing instructions to the camera and the output mechanism are wired or wireless connections.

A waste receptacle is a container or device capable of containing solid refuse. Optionally, the waste receptacle may be provided with a lid or a lid and a foot-operated mechanism for opening the lid.

In an additional embodiment, methods and devices are provided to analyze waste placed in a garbage disposal attached to, for example, a kitchen sink. One or more cameras that are able to image the contents of the garbage disposal first chamber may be associated with the garbage disposal. The first chamber of the garbage disposal is the chamber in which refuse resides before the disposal is activated and the refuse is ground and washed into the drain system. Images of the disposal before it is activated provide useful information. Images before the disposal is activated can be obtained by continuously storing a rotating buffer of periodic pictures (e.g. one every 30 seconds) and storing the buffer when the disposal was activated. This would effectively store pictures taken just before the disposal was activated. The images captured by the camera(s) are communicated to a docking or a base station through a wired or wireless connection.

A docking station comprises a processor, data storage system(s), and input/output ability. A docking station may optionally have the capability to provide power to the sensing systems of the waste receptacle (e.g., the one or more cameras, photosensors, lighting, and scale). The docking station has the ability to receive data from the sensing system of the waste receptacle either through wired or wireless connectivity. The docking station also comprises a memory system (or data storage system), such as for example ROM (read only memory), RAM (random access memory), flash memory, or a combination thereof. The memory system is capable of storing data received from the sensing system. For example, the memory system is capable of storing images received from the camera for later analysis by and or transmission to a caregiver. The caregiver may monitor the images for analysis of dietary habits, for example, in order to understand and or intervene if a health issue, such as diabetes, worsens. The docking station may also comprise a processor that is capable of analyzing the data received from the imaging system. The docking station may also have the ability to send data to the waste receptacle. For example the docking station optionally activates an alert indicating that the imaging system is non-functional. The docking station is optionally capable of supplying power to the waste receptacle. Power may be supplied through the USB cable connecting the sensing systems and the base station, for example. The docking station further optionally comprises one or more output ports capable of communicating with a base station, telephone system, or internet system. The data communicated by the docking station to a base station or caregiver may be the raw sensor data or it may be data that has been processed by algorithms on the docking station. The docking station is optionally capable of receiving data from a base station, remote server, or remote caregiver. Additionally, optionally the docking station may be associated with various peripherals, such as, for example, a display, input buttons, a keyboard, a printer, a disk drive, a CD reader/burner, a mouse, a trackpad, a screen, or a touchscreen.

Optionally, embodiments of the present invention may also comprise a base station and or be able to communicate with a base station. The functions performed by the docking station may instead be performed entirely by the base station. A base station typically comprises a computer, either a multipurpose computer or a computer dedicated to health monitoring activities. The base station comprises a processor, data storage system(s), and input/output ability. Data storage systems include for example ROM (read only memory), RAM (random access memory), flash memory, or a combination thereof. For example, the memory system is capable of storing images received from the camera for later analysis by and or transmission to a caregiver. The caregiver can examine images in response to an alarm to determine if a problem exists. For example, the caregiver may be able to determine that no problem exists because the individual being monitored has been eating out, for example, from the presence of take-out containers in the waste receptacle. The base station is capable of communicating with remotely located computers or devices, such as a computer in a caregiver's home or office. Communication can be through a telephone connection or through the internet, such as for example, through a DSL (digital subscriber line) or cable modem internet connection. The base station is capable of receiving input from one or more sensors and storing the input. Typically the data will be received by the base station wirelessly, through a LAN (local area network), but the base station optionally comprises wired communication ability, such as, USB, or firewire ports. The base station is also capable of processing information received from the one or more sensors for output to a remote location. Optionally, the data processing comprises analyzing output of one or more sensors and providing an output based on the result of the processing. For example, the base station stores images from the cameras and or weight measurements from the scale for later access. Algorithms for analyzing the data are optionally located on the base station or on a computer in a remote location. The images over time are analyzed to determine the level of waste in the receptacle over time. If the level of waste has not changed for a certain period of time (for example, for four hours during daylight) an alarm is sent to a caregiver alerting the caregiver to the existence of a possible problem. If the waste receptacle is equipped with a scale, the weight of the contents of the receptacle over the same time period can be analyzed to determine if there has been a change. If, for example, the weight of the receptacle is constant the alarm is sent. If the weight has changed, the alarm is not sent. Alarms may also be transmitted from the base station or through the base station to the waste receptacle to indicate that the sensors system of the waste receptacle is or is not functioning. Additionally, optionally the base station may be associated with various peripherals, such as, for example, a display, input buttons, a keyboard, a printer, a disk drive, a CD reader/burner, a mouse, a trackpad, screen, or a touchscreen.

Image processing algorithms useful in embodiments of the present invention include algorithms that compare the area of an interior side of the waste receptacle that is visible (not covered by waste) to the area that was visible at an earlier time. In an exemplary embodiment, an image processing algorithm performs a pixel analysis on an image $I_1$ taken at time $T_1$ (which may be an initial image taken when the waste receptacle was empty, taken during initialization or startup) to determine how much of the side of the interior of the waste receptacle is visible and compares it with an analysis of an image $I_2$ taken at time $T_2$. The pixel analysis may be performed using the color of the side of the waste receptacle. Pixels that are not the right color are rejected, and the areas of the pixels having the right color are tabulated to determine the area of waste receptacle side visible. The area $A_2$ found in image $I_2$ is subtracted form $A_1$ the area found in image $I_1$ to determine whether waste has been added to the receptacle (if $A_1-A_2>0$, then waste has been added). A threshold area, $A_{th}$, may be set such that if $A_1-A_2<A_{th}$, for $T_1-T_2>T_{th}$, then a caregiver is notified for a system in which images are taken. The caregiver can then examine saved images of the waste to determine if waste the same color as the receptacle side has been placed in the receptacle or if some other problem exists. An additional threshold may be set $A_{th2}$, such that if $A_1-A_2<A_{th2}$, a more urgent notification is sent to the caregiver. A variety of thresholds may be set to provide useful information to a caregiver. The time interval between $T_1$ and $T_2$ is set so that images that are analyzed are far enough apart in time so as to provide meaningful information to an automated caregiver notification system.

Figure 3:
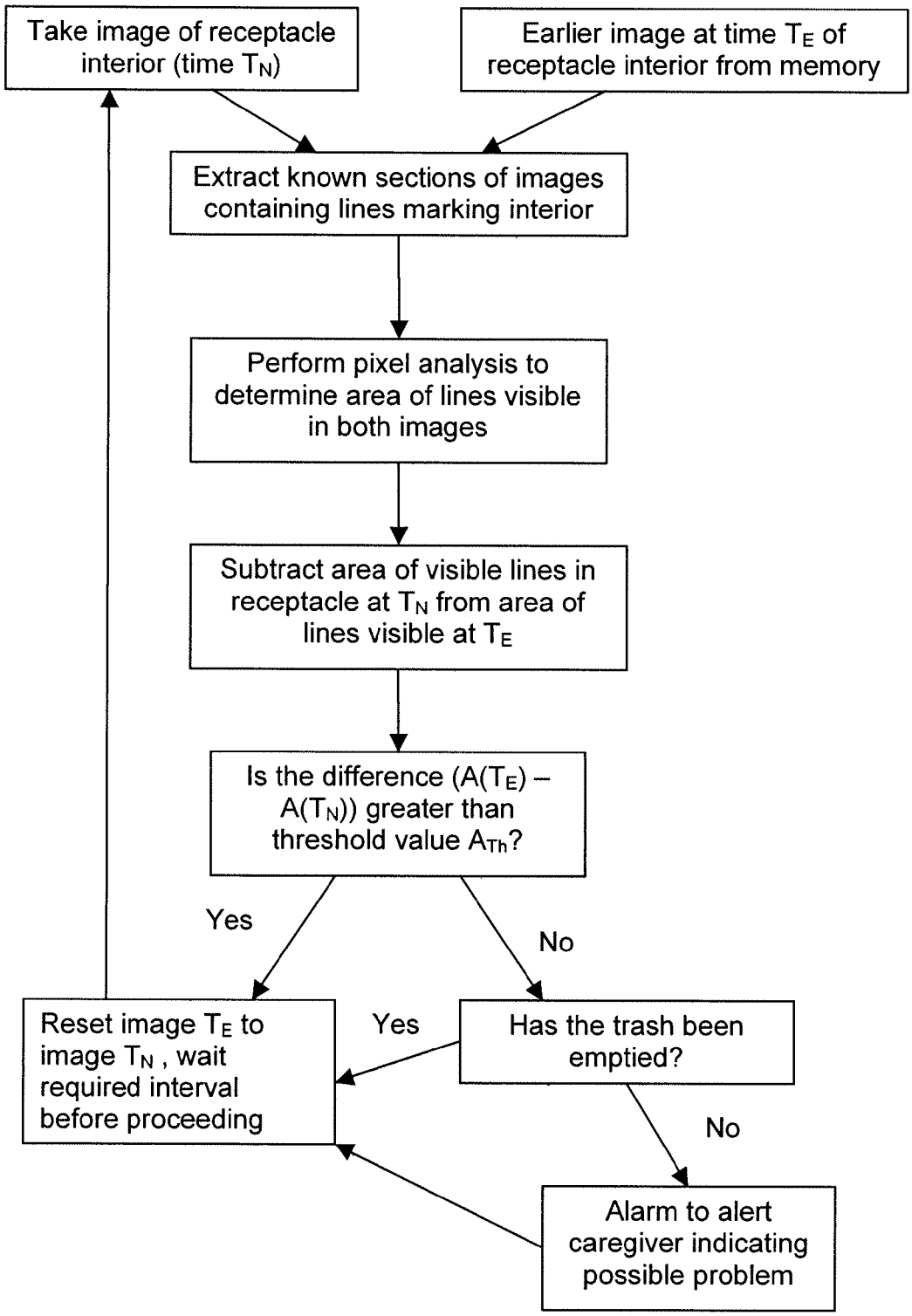
FIG. 3 provides an exemplary flowchart for automatic analysis of the contents of a waste receptacle.

Referring now to FIG. 3, a flowchart of an exemplary data analysis scheme for automatically monitoring the contents of a waste receptacle and providing an automated alert notification is provided. In FIG. 3, images from a waste receptacle having lines in the interior are analyzed. Pixel analysis is performed on images from the waste receptacle from a time $T_E$ and a time $T_N$. Time $T_E$ is earlier than time $T_N$ and the interval between $T_E$ and $T_N$ is selected in order to provide meaningful data to an alert notification system. The interval between $T_E$ and $T_N$ may be varied depending on time of day. The images $I_E$ and $I_N$ may be gathered automatically at set time intervals and or may be the result of images captured after waste receptacle use. In the analysis, known sections of the images containing the lines are extracted and a pixel analysis is performed whereby pixels in the areas extracted are selected if they are the same color as the color of the lines. Areas are computed from the selected pixels where $A(T_E)$ is the area of the selected pixels from the image $I_E$ and $A(T_N)$ is the area of the selected pixels from the image at $T_N$. The difference $A(T_E)-A(T_N)$ is calculated and decision is made whether or not to alert a caregiver based on whether $A(T_E)-A(T_N)$ is greater than a set threshold value, $A_{th}$. The automated process can then repeat to continue monitoring waste activity. The algorithm determines whether the trash has been emptied by comparing $T_N$ to an initial $T_{Ei}$ taken during system initialization or setup at a time when the receptacle was empty. If $A(T_{Ei})-A(T_N)=0$ then the trash has been emptied. Alternatively, weight information from a scale may be used to determine whether the waste receptacle has been emptied, such that if $W_N=W_i$ then the waste receptacle has been emptied (where $W_N$ is the current value for a weight measurement and $W_i$ is an initial value for the empty receptacle. Further alternatively or in addition to other methods for determining that the trash has been emptied, a manual reset button or input device may be provided that a user can depress or activate to manually indicate to the waste receptacle that the waste has been emptied.

In alternate embodiments, lines are used to determine levels of trash. Lines are processed starting at the bottom and a decision is made as to whether a line is covered by trash or not. For example, if pixel analysis reveals that more than half the line is covered by trash, the line is considered to be covered by trash. The number of lines covered by trash provides a level of trash. An alert threshold is determined from an analysis of the average behavior of an individual. For example, if an elder typically throws away about one line's worth of trash per day, then anything less causes a notification to be sent to a caregiver.

Figure 4:
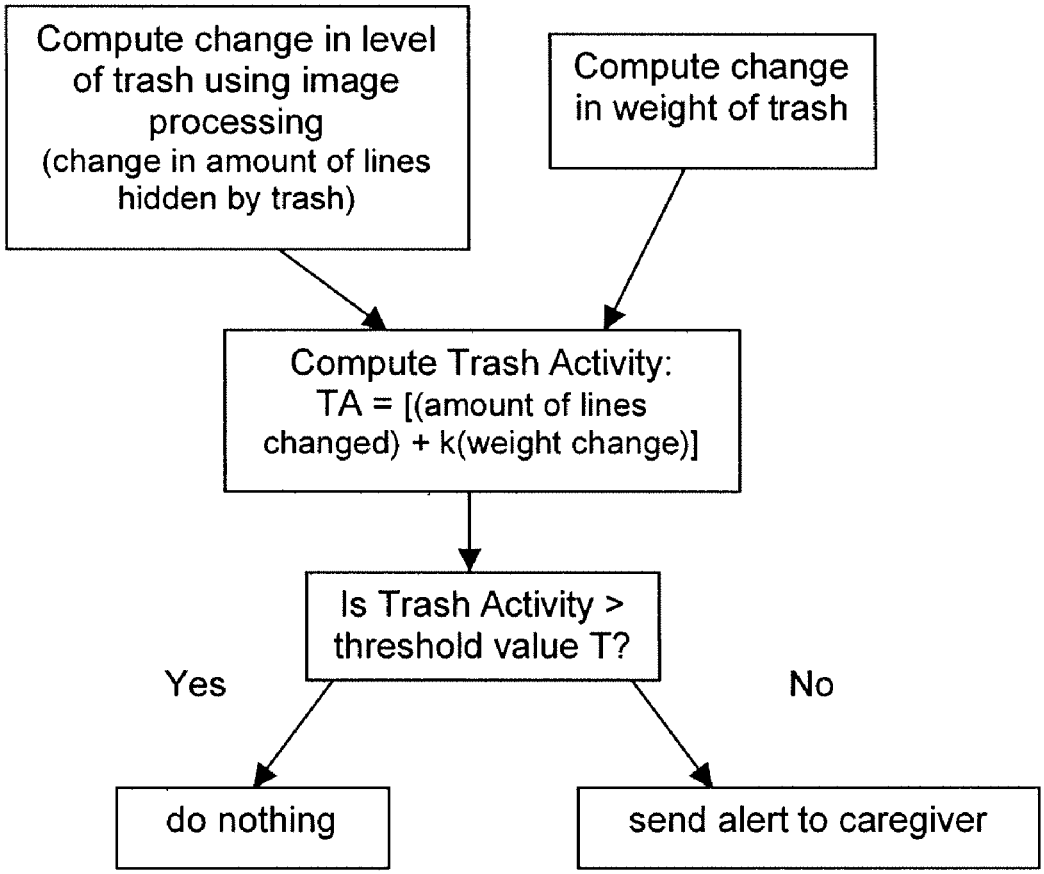
FIG. 4 provides an additional exemplary flowchart for automatic analysis of the contents of a waste receptacle.

FIG. 4 provides an additional algorithm demonstrating an exemplary method for monitoring the contents of the waste receptacle. In this method, a result from the image processing analysis, such as a change in the amount of lines hidden by the trash (a change in calculated area of the lines) is added to a change in weight for the same time interval. The change in weight is multiplied by a constant, k, that is selected to provide a value for the weight difference that is similar in magnitude to the change in area and depends on the units selected for the weight measurement. The sum of the values is compared to a threshold value and if the value is below the threshold, an alert is sent to a caregiver. The process is repeated to provide continuous monitoring.

We claim:

1. A monitoring system comprising:

a waste receptacle having an interior;

a camera attached to the waste receptacle wherein the camera is positioned so that it is capable of capturing a digital image of the interior of the waste receptacle and wherein the camera is capable of transmitting the image of the interior of the waste receptacle;

a image analysis component, wherein the image analysis component comprises a computer-readable medium having computer-executable instructions stored thereon, wherein the computer-executable instructions are capable of receiving a first digital image captured at a first time and a second digital image captured at a second time of the interior of the waste receptacle from the camera and comparing the first image to the second image to determine a difference between the first and the second image; and a decision output component, wherein the decision output component comprises a computer-readable medium having computer-executable instructions stored thereon wherein the computer-executable instructions are capable of providing an alert if the difference between the first and the second image is below a threshold value.

2. The monitoring system of claim 1 also comprising a weight measuring device wherein the weight measuring device is capable of determining a weight of the contents of the waste receptacle and an output component capable of providing an output reflecting the value of a weight determination to a weight analysis component wherein the weight analysis component is capable of determining weight change over time.

3. The monitoring system of claim 2 wherein the weight analysis component is capable of providing an alert as a result of the determination of weight change over time.

4. The monitoring system of claim 1 also comprising a weight measuring device wherein the weight measuring device is capable of determining a weight of the waste receptacle and an output component capable of providing an output reflecting the value of a weight determination to a weight analysis component wherein the weight analysis component is capable of determining weight change over time.

5. The monitoring system of claim 4 wherein the weight analysis component is capable of providing an alert as a result of the determination of weight change over time.

6. The monitoring system of claim 1 also comprising an image storage component wherein the image storage component is capable of storing a plurality of images of the interior of the waste receptacle.

7. The monitoring system of claim 1 wherein the alert is in the form of a notification sent to a remote computer, remote handheld computer, remote personal digital assistant, remote telephone messaging system, or remote telephone.

8. A method of monitoring human activity comprising:

providing a waste receptacle having an interior wherein the waste receptacle comprises a camera capable of imaging the interior of the waste receptacle, and wherein the waste receptacle is capable of supplying images of the interior of the waste receptacle to an image analysis system;

providing a plurality of images of the interior of the waste receptacle to an image analysis system; wherein a first image is captured at a first time and a second image is captured at a second time;

analyzing the images of the interior of the waste receptacle to determine whether or not a change in the contents of the waste receptacle in the time interval between the first time and the second time has occurred wherein the analysis occurs on a programmable data processing machine;

determining whether or not to send an alert as a result of the determination of whether or not a change has occurred in the contents of the waste receptacle wherein the determination occurs on a programmable data processing machine.

9. The method of claim 8 also including:

providing a weight measuring device wherein the weight measuring device is capable of determining the weight of the contents of the waste receptacle; and determining a weight for the contents of the waste receptacle at least two different times and determining whether or not a change has occurred in the contents of the waste receptacle based on a change in weight of the contents of the waste receptacle wherein the determination occurs on a programmable data processing machine.

10. The method of claim 8 also including:

providing a weight measuring device wherein the weight measuring device is capable of determining the weight of the contents of the waste receptacle; and determining a weight for the waste receptacle at least two different times and determining whether or not a change has occurred in the contents of the waste receptacle based on a change in weight of the waste receptacle wherein the determination occurs on a programmable data processing machine.

11. The method of claim 8 wherein the alert is in the form of a notification sent to a remote computer, remote handheld computer, remote personal digital assistant, remote telephone messaging system, or remote telephone.

12. The method of claim 8 also including storing a plurality of images of the interior of the waste receptacle to a data storage device wherein the images can be retrieved from the data storage device.

* * * * *